United States Patent [19]

Kamohara

[11] Patent Number: 4,672,269

[45] Date of Patent: Jun. 9, 1987

[54] BUILT-IN RESISTOR FOR A CATHODE RAY TUBE

[75] Inventor: Eiji Kamohara, Saitama, Japan

[73] Assignee: Kabushiki Kaisha Toshiba, Kawasaki, Japan

[21] Appl. No.: 744,384

[22] Filed: Jun. 13, 1985

[30] Foreign Application Priority Data

Jun. 14, 1984 [JP] Japan ..... 59-120819
Nov. 22, 1984 [JP] Japan ..... 59-246256

[51] Int. Cl.[4] ..... H01J 23/16
[52] U.S. Cl. ..... 315/3.0; 338/219; 338/283; 338/308
[58] Field of Search ..... 315/3.0; 338/211, 219, 338/226, 283, 308

[56] References Cited

U.S. PATENT DOCUMENTS 2,709,229 5/1955 Linder ..... 315/3
3,360,678 12/1967 Kerns ..... 315/3
4,366,415 12/1982 Takenaka et al. ..... 315/3
4,402,037 8/1983 Iwamura et al. ..... 338/219

FOREIGN PATENT DOCUMENTS 5389360 1/1979 Japan .
2028576 3/1980 United Kingdom ..... 315/3

*Primary Examiner*—Harold Dixon
*Attorney, Agent, or Firm*—Cushman, Darby & Cushman

[57] ABSTRACT

A structure for a resistor to be built into a cathode ray tube. The built-in resistor divides an applied anode potential into an intermediate focusing potential. The built-in resistor has a main resistor and an additional resistor means. The additional resistor means is serially connected to the main resistor. The additional resistor means provides a plurality of resistors, one of which is selected for fine adjusting the divided potential.

39 Claims, 10 Drawing Figures

BUILT-IN RESISTOR FOR A CATHODE RAY TUBE

BACKGROUND OF THE INVENTION

The present invention relates in general to cathode ray tube (CRT) structural arrangements. More specifically, the invention is directed to the structure of a resistor built into the CRT envelope.

In a color CRT a focusing potential of 5 KV to 8 KV is required. A high potential slightly lower than the anode potential, such as 25 KV to 30 KV, is also required in a mask focusing color CRT. Such focusing or high potential voltage are provided to respective electrodes through stem pins mounted on a neck of the tube envelope. To reduce deflection power consumption a diameter of a neck of the tube envelope is narrowed. With the neck narrowed, the pins of the CRT are close to one another. The use of high potential voltages causes the problem of withstanding high voltage at the stem portion of the CRT and also complicates the stem structure.

To solve this problem, a CRT having a resistor built in the tube envelope was proposed in Japanese Utility Model Nos. 48-21561 and 55-38484 and U.S. Pat. Nos. 3,932,786 and 4,143,298. The teachings of these documents are hereby incorporated by reference as if fully set forth herein.

The resistor divides the applied potential, such as an anode potential applied from an anode button provided on a funnel of the tube envelope, into an intermediate high potential such as a focusing potential. The resistor built in the neck of the tube envelope must be made small because of the small space available the neck. The resistor must have a very high resistance value, for example $500\times10^6$ ohms, because a high potential of 25 KV to 30 KV is applied to the resistor and a power consumption in the resistor must be low. Thus, the resistor must have a small volume and a high resistance value. However, it is difficult to control a value of the resistance of such resistor in a mass production.

A known resistor of such type comprises a ceramic insulating substrate and a zigzag shaped resistive layer printed on the substrate. The resistive layer is made of a mixture of ruthenium oxide and glass. However in production, such resistors have resistance values in a range of about $\pm10\%$ depending upon the production process. So, a divided potential provided by such resistors also varies from one resistor to another. Consequently a cathode ray tube having a built-in resistor must have some voltage adjusting means, such as a variable resistor, provided outside of the tube envelope. Even if the adjusting means is utilized, when the deviation from nominal value of the resistance value is large its deviation can not be fully adjusted or compensated by the adjusting means. Further, the built-in resistor set outside of the tube must also have very high resistive value, for example 100 to $500\times10^6$ ohm. Mass production of such high resistance variable resistors is difficult.

SUMMARY OF THE INVENTION

A primary object of the present invention is to provide a resistor having a selectable resistive value.

Therefore the present invention provides a built-in resistor having "built-in" means for adjusting its resistance value so that a desired resistance value can be obtained despite normal manufacturing tolerances. It includes a "main resistor" portion and an "additional" resistor for providing adjustment.

Even if the resistive value of the main resistor is deviant from the desired or nominal value as a result of the production process, the resistive value of the built-in resistor can be adjusted by adjusting the additional resistor. Thereby a divided potential obtained becomes within a preferably adjustable range. A fine adjustment of the divided potential can be carried out by a variable resistor serially connected to the additional resistor, which variable resistor is provided outside the tube envelope. If the resistance value of the additional resistor is proper, the divided potential can be made precise without any further variable resistor.

BRIEF DESCRIPTION OF THE DRAWINGS

The invention will be described in detail with reference to the accompanying drawings, wherein.

DETAILED DESCRIPTION OF THE PREFERRED EMBODIMENT

Figure 1:
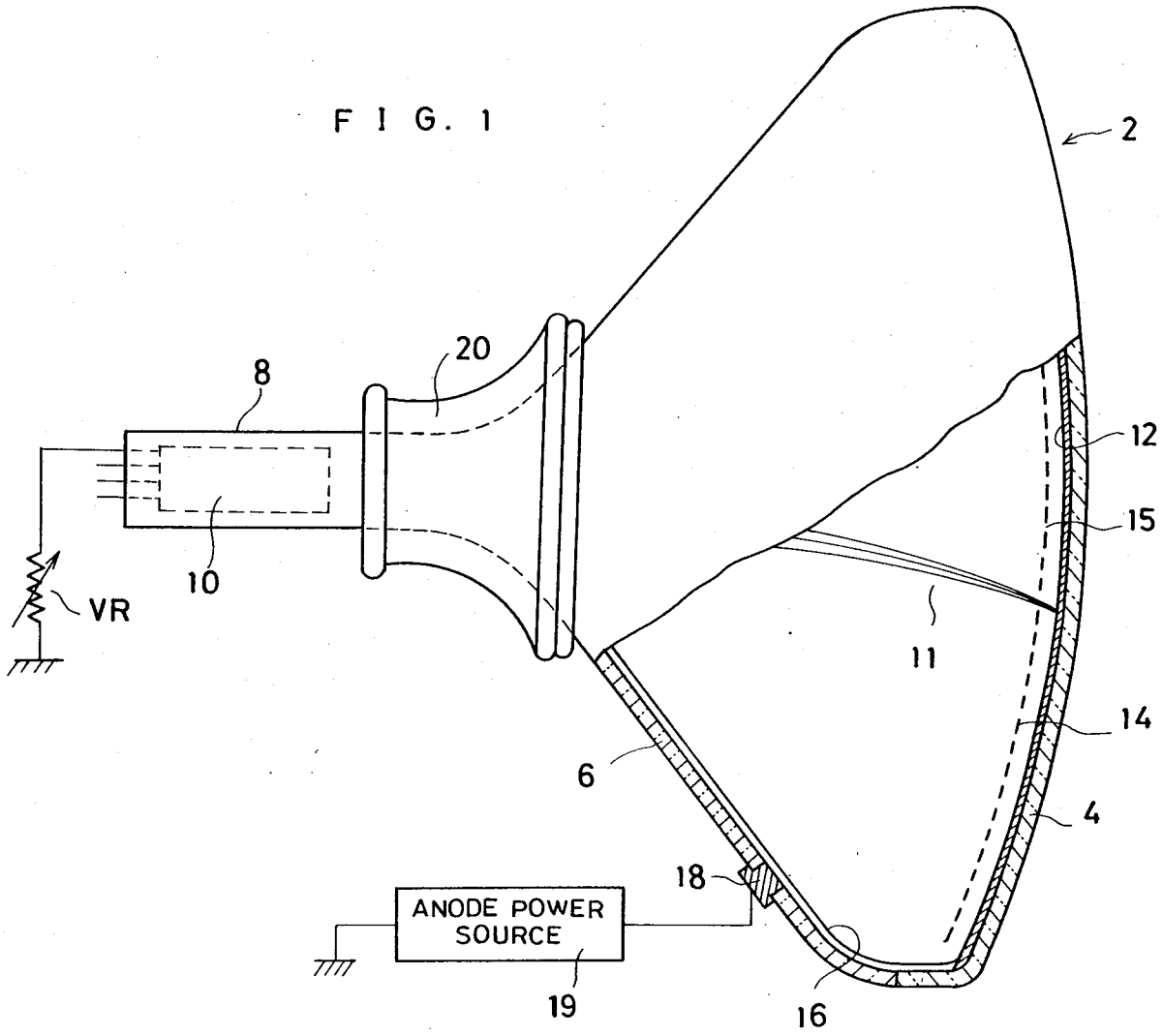
FIG. 1 is a cross section of a color cathode ray tube utilizing a resistor according to the present invention.

Referring now to FIG. 1, a color cathode ray tube (CRT) is shown. A tube envelope 2 has a panel 4, a funnel 6 and a neck 8. An electron gun assembly 10 for emitting three electron beams 11 is disposed in the neck 8. A phosphor screen 12, which emits three different colors red, green and blue, is coated on an inner surface of the panel 4. In the vicinity of the phosphor screen 12 a color selection electrode 14 is provided. An inner conductive layer 16 is coated on an inner surface of the funnel 6. An anode button 18, which is in electrical contact with the inner conductive layer 16, is mounted on the funnel 6.

The anode button is supplied with an anode potential from an anode power source 19. A deflection yoke 20 is mounted on an outer surface of the funnel 6. Electron beams 11 emitted from the electron gun assembly 10 are deflected by yoke 20 and pass through an aperture 15 of the color selection electrode 14. Then, the electron beams impinge the phosphor screen 12 causing it to emit color light which, in turn, causes a color image to be displayed on panel 4.

Figure 2:
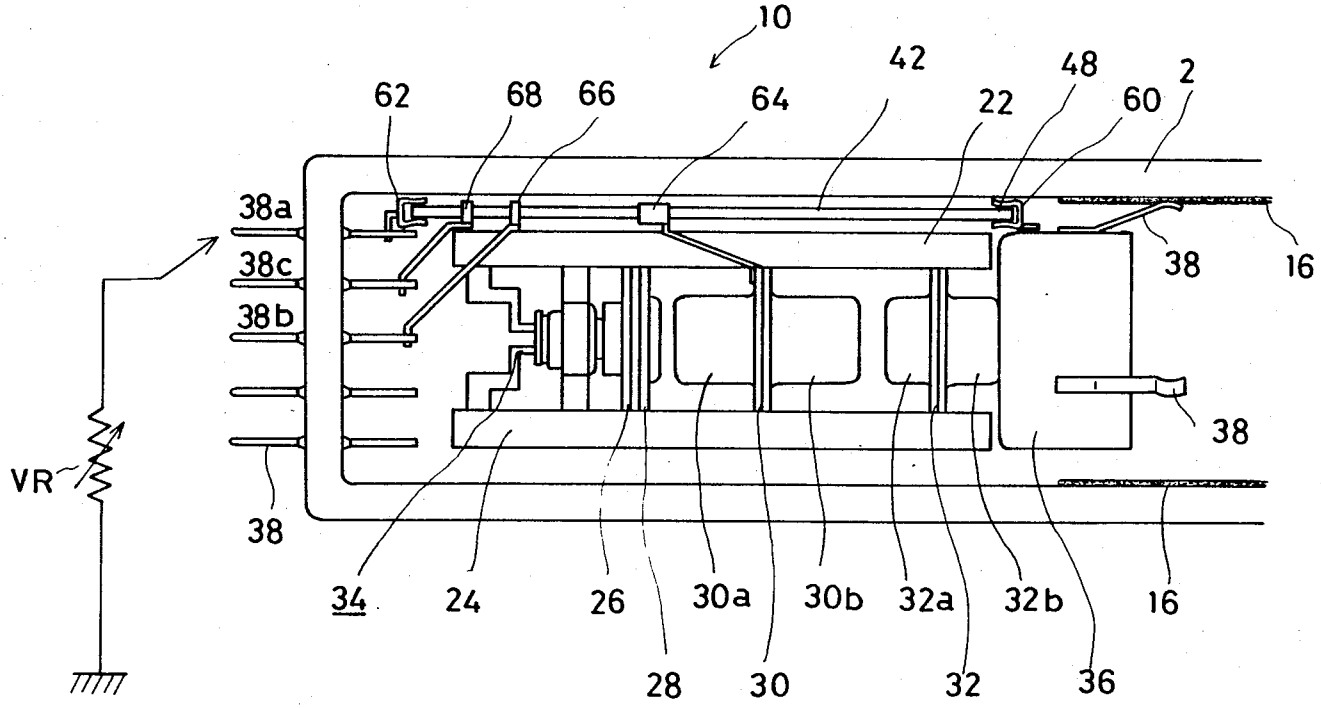
FIG. 2 is a cross section of a neck portion of cathode ray tube having a built-in resistor according to the present invention.

FIG. 2 shows the detail of a neck portion of the cathode ray tube. In neck 2 of the tube envelope, the electron gun assembly 10 is disposed. The electron gun assembly 10 includes a pair of insulating glass beads 22 and 24, a plurality of grid electrodes 26, 28, 30 and 32 attached to the glass beads 22 and 24 and a cathode structure 34 attached to the glass beads 22 and 24. The cathode structure 34 emits three electron beams, which are focused and accelerated by the grid electrodes 26, 28, 30 and 32 and then strike the blue, red and green phosphors coated on an inner surface of a face plate of the tube envelope. Grid electrodes 26, 28, 30 and 32 are arranged along the electron beams travelling direction and each electrode has three apertures corresponding to the three electron beams. First and second grid electrodes 26 and 28 are plate like electrodes and positioned in the vicinity of the cathode structure 34. The third electrode 30, which is a focusing electrode, has two cup-like electrodes 30*a* and 30*b* with openings facing each other. The fourth electrode 32 has also two cup-like electrodes 32*a* and 32*b*. On cup-like electrode 32*b* facing the phosphor screen a cup shape convergence electrode 36 is mounted. Convergence electrode 36 has three apertures for passing the three electron beams, respectively. Three bulb spacers 38 are attached to the convergence electrode 36. One end of each bulb spacer 38 is abutting an inner surface of neck 2 and holds the electron gun assembly 10 in the neck 2. The cathode structure side of the gun assembly 10 is held to stem pins 38 by lead wires (not shown) connecting between the cathode structure 34 and the grid electrodes 26 and 28. The bulb spacers 38 are in electrical contact with the inner conductive layer 16. The inner conductive layer 16 is in electrical contact with anode button 18, so the anode potential is applied to the convergence electrode 36 and to fourth electrode 32.

Figure 3:
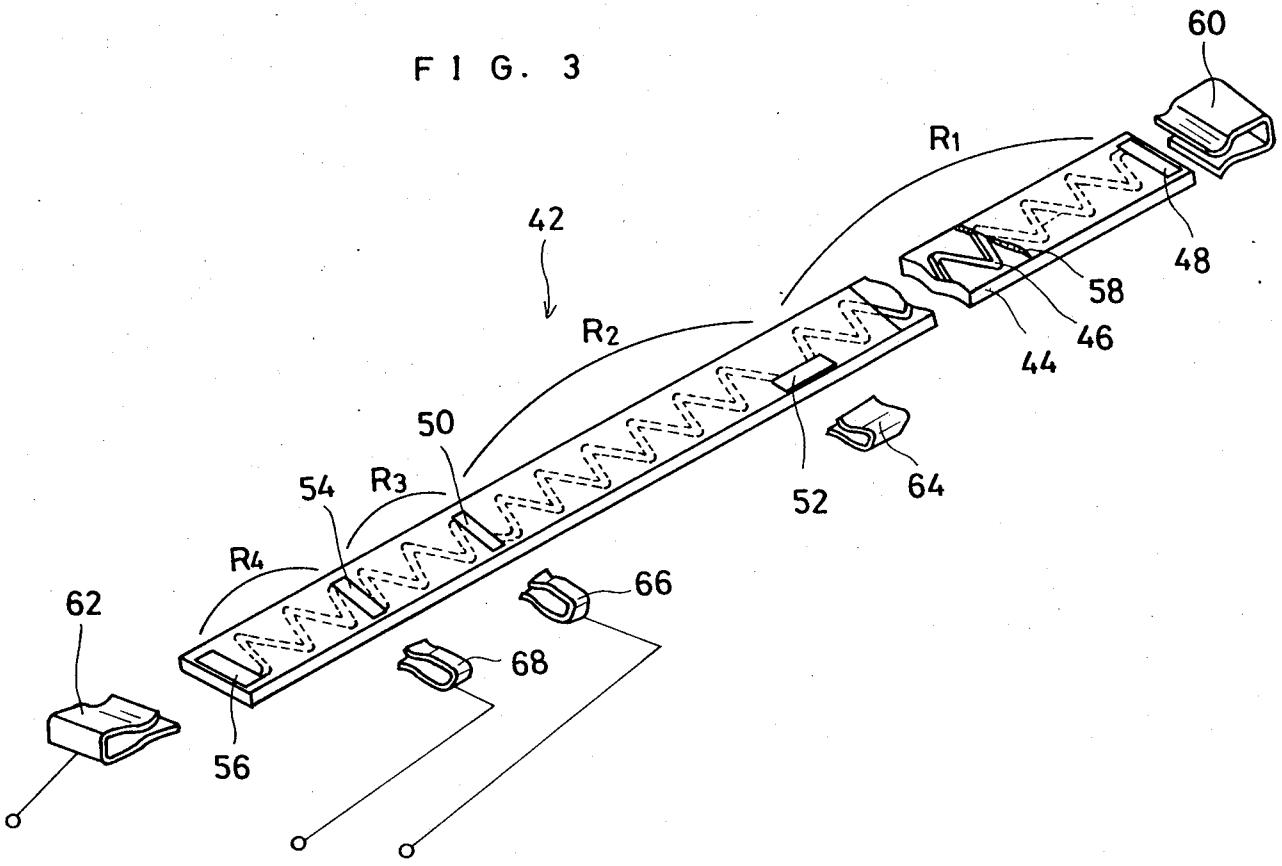
FIG. 3 is a perspective view of a resistor according to the present invention.

A built-in resistor 42 of the present invention is positioned in the vicinity of the glass bead 22. Referring to FIG. 3 the built-in resistor is shown in detail. Resistor 42 has a ceramic insulating substrate 44, a zigzag shaped resistive layer 46 provided on the substrate 44. The resistive layer 46 is made of a mixture of ruthenium oxide and glass. At one end of the substrate is provided a terminal 48 and near the other end of the substrate there is provided another terminal 50. A resistive value between terminals 48 and 50 is very high, preferably 500 to $5000\times10^6$ ohm. Another terminal 52 is positioned between terminals 48 and 50. A main resistor is formed between the terminals 48 and 50. Two other terminals 54 and 56 are provided near the second terminal 50. An additional resistor is formed between terminals 50 and 56. Terminals 48, 50, 52, 54 and 56 are made of a resistive material having a lower resistance than that of resistive layer 46, such as a relatively low resistive material including ruthenium oxide as its chief constituent, or made of conductive paint including silver or gold. Surfaces of resistive layer 46 and substrate 44 are covered by an insulating coating 58 such as, for example, glass except for the terminals 48, 50, 52, 54 and 56. A first connector 60 and an end connector 62 made of elastic conductive material are attached to the terminals 48 and 56, respectively. Further, other connectors 64, 66 and 68 are attached to the terminals 52, 50 and 54 respectively. Resistive values among terminals 48, 50, 52, 54 and 56 are denoted by $R_1$, $R_2$, $R_3$ and $R_4$ shown in FIG. 3.

Referring back to FIG. 2, connector 60 is welded to the convergence electrode 36 and the end connector 62 is welded to a stem pin 38*a*, thereby the resistor 42 is held in neck 2. Terminal 48 is electrically connected to the anode button 18 mounted on the funnel 4 through the first connector 60, the convergence electrode 36, the bulb spacers 38 and the inner conductive layer 16. The connector 64 is electrically wired to the third electrode 30 and other connectors 66 and 68 are wired to stem pins 38*b* and 38*c* respectively.

Figure 4:
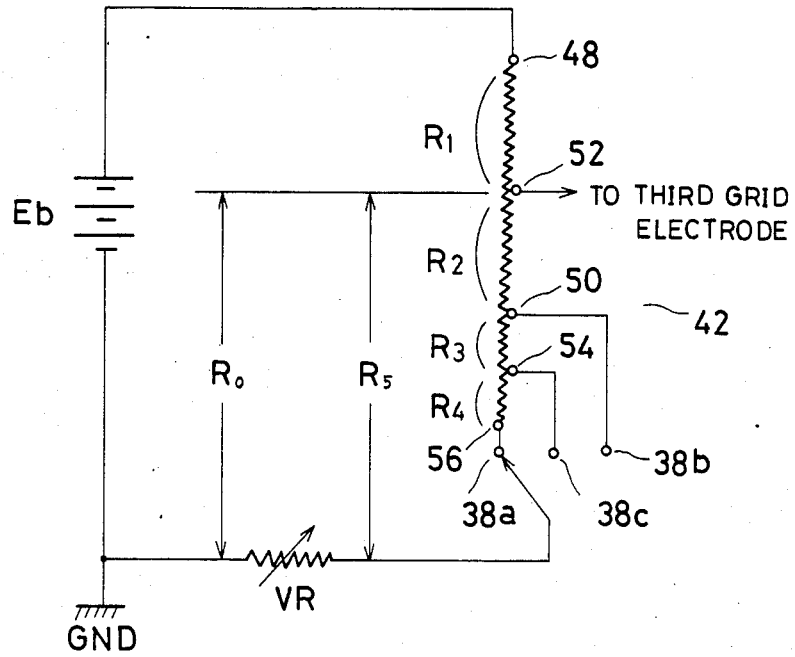
FIG. 4 is a schematic diagram of equivalent circuit of the embodiment of the present invention shown in FIG. 2.

Referring now to FIG. 4, there is shown a schematic diagram of an equivalent circuit formed in an operation of the color cathode ray tube. Eb denotes the anode voltage applied to the resistor 42, VR denotes a variable resistor outside of the CRT and $R_0$ denotes a resistive value between the terminal 52 and a ground GND. A resistive value $R_5$ can be adjusted by selecting the stem pins 38*a*, 38*b* and 38*c* to be connected to the variable resistor VR. A potential of the terminal 52 is determined by a division ratio between $R_0$ and $R_1$ when a current of the third grid electrode is neglected. A resistive value of $R_5$ can be widely changed so that the potential of terminal 52, which is connected to the third grid electrode, can be widely adjustable. Therefore, even if the resistive value of main resistor is largely deviated from the designed value depending upon the production process, selecting the stem pins 38*a*, 38*b* and 38*c* makes it possible to adjust the potential of the third grid electrode 30 within a preferable and adjustable voltage range. The divided potential at terminal 52 can be finely adjusted to the predetermined potential by the variable resistor VR.

In designing the built-in resistor the variety of the resistive depending upon the mass-production is considered. When the focusing potential is required to be 30% of the anode potential Eb, a divisional ratio of $R_2/(R_1+R_2)$ is designed to be 0.2. An embodiment of the built-in resistor is designed so that $R_1+R_2$ is $1000\times10^6$ ohm, $R_2$ is $200\times10^6$ Ohm, $R_3$ is $100\times10^6$ ohm and $R_4$ is $100\times10^6$ Ohm. When the divisional ratio is varied to about 0.3, no additional resistor means is utilized in the tube envelope. When the divisional ratio is varied to about 0.1, $R_3$ and $R_4$ are utilized as additional resistor means. When a divisional ratio of about 0.2 is obtained $R_3$ is utilized as additional resistor means. In each case the variable resistor VR of several megaohm to $30\times10^6$ Ohm is utilized for fine adjustment outside the tube envelope.

In the prior art without additional resistor means, a variable resistor provided outside the tube envelope must have a resistive value of 200 to $300\times10^6$ Ohm to compensate a deviation of the built-in resistor. However such high resistive variable resistor is difficult to produce and can not be obtained at low price in a commercial market. On the contrary the variable resistor utilized in the present invention is easy to produce and is obtained at low price.

According to the present invention, the variable resistor outside the tube envelope can be omitted. Generally, a cathode ray tube is designed to have a focusing potential which is 30% of the anode potential. The focusing potential must be set within a range of 29% to 31% of anode potential so as to not degrade the focus characteristics on a screen. Even if a severe quality control is done in the production process of the built-in resistor, the deviation of the divisional ratio is more than 1%. In the present invention to compensate the deviation the additional resistive means is applied to the built-in resistor. In this case the additional resistive means compensates the deviation of about 1% and such deviation can be compensated easily by additional resistive means without the variable resistor outside the tube envelope. Such embodiment is designed so that $R_1+R_2$ is $1000\times10^6$ Ohm, $R_2$ is $290\times10^6$ Ohm, $R_3$ is $10\times10^6$ Ohm and $R_4$ is $10\times10^6$ Ohm. In this case the variable resistor is not necessary outside the tube envelope so that a cathode ray tube having this built-in resistor is a convenience for TV set maker. However a severe quality control of the production process of the built-in resistor is necessary and a cost of the built-in resistor becomes high compared to the afore-mentioned embodiment. The greater the number of the terminals provided on the additional resistor means, the finer the adjustment.

Figure 5:
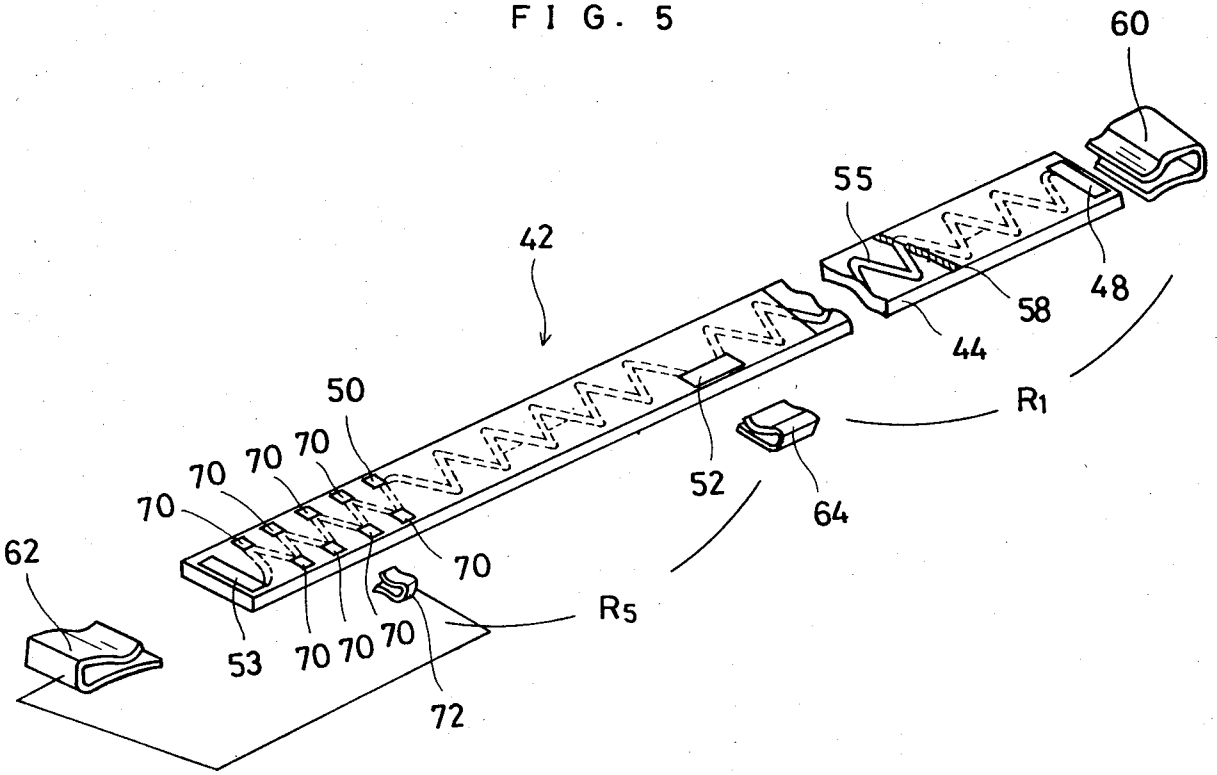
FIG. 5 is a perspective view of another embodiment of the present invention.
Figure 6:
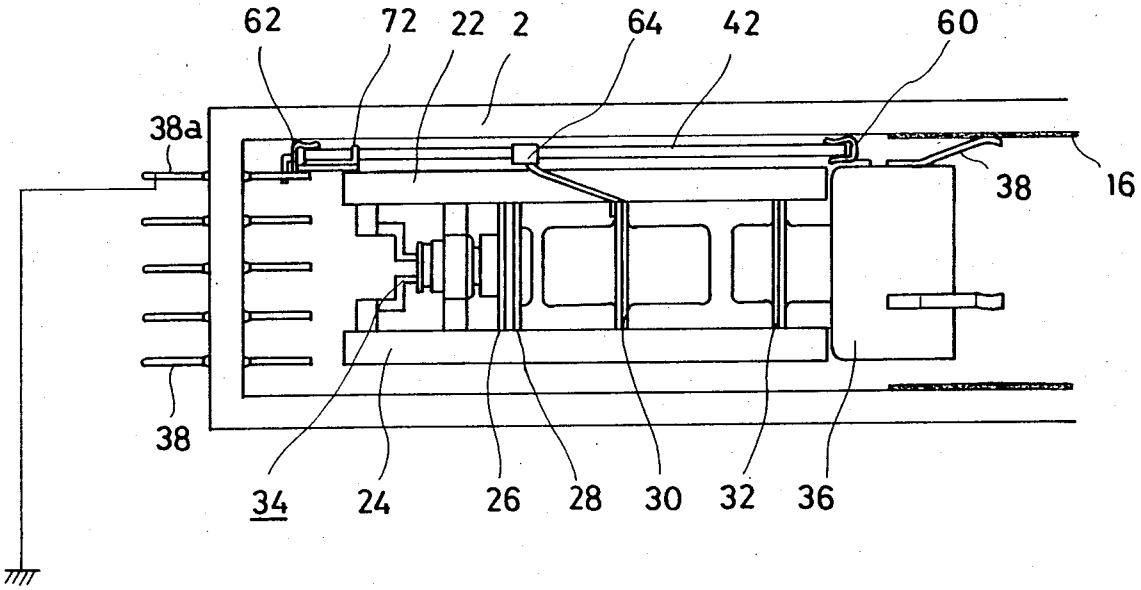
FIG. 6 is a cross section of a neck portion of cathode ray tube having the built-in resistor shown in FIG. 5.

FIGS. 5 and 6 show another embodiment of the present invention. In this embodiment a resistive value of the resistor is preset before the resistor is built in the neck. Only one stem pin is used for connection to the terminal of the additional resistor means. Referring now to FIG. 5, resistor 42 has additional resistor having a plurality of fine adjusting terminals 70 near the end of subtrate 44. The fine adjusting terminals 70 have smaller pads than the other terminals 48 and 52 because many terminals 70 are provided in a small area. One of the fine adjusting terminals is selected and electrically connected to the end terminal 53 positioned at the end of the substrate 44. One of the fine adjusting terminals is selected to provide a predetermined potential to the third terminal 52. For this purpose a resistive value $R_1$ between the first and third terminals 48 and 52 and a resistive value $R_5$ between the fine adjusting terminals 73 and the third terminal 52 are measured. A small connector 72 is attached to the selected terminal and is wired to the end connector 62. The resistor 42 is attached and electrically connected to the electron gun assembly 10 in a same manner described with respect to the first embodiment. The third terminal is also wired to the third grid electrode 30.

Figure 7:
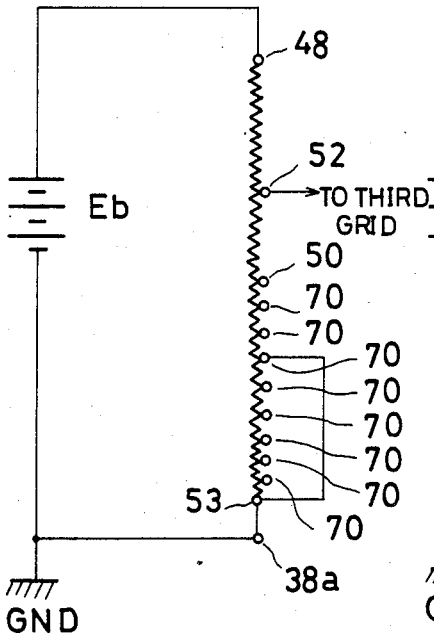
FIG. 7 is a schematic diagram of equivalent circuit of the embodiment of the present invention shown in FIG. 6.

FIG. 7 shows an electrical equivalent circuit of this embodiment. In this embodiment many fine adjusting terminals are provided and the built-in resistor can be fine adjusted to a desired resistance value so that the variable resistor provided outside the tube envelope can be omitted. Of course the variable resistor can be utilized for further fine adjustment by a television set manufacture who utilizes the CRT including the resistor of the present invention. Furthermore only one stem pin is required for the resistor, so that gaps between the stem pins can be wide compared to the first embodiment and therefore can withstand even greater voltages. It can be understood that the end terminal and end connector 53 and 62 can be omitted and the small connector 72 is directly wired to the stem pin 38*a* when the resistor 42 is mounted in the neck in some other manner.

Figure 8:
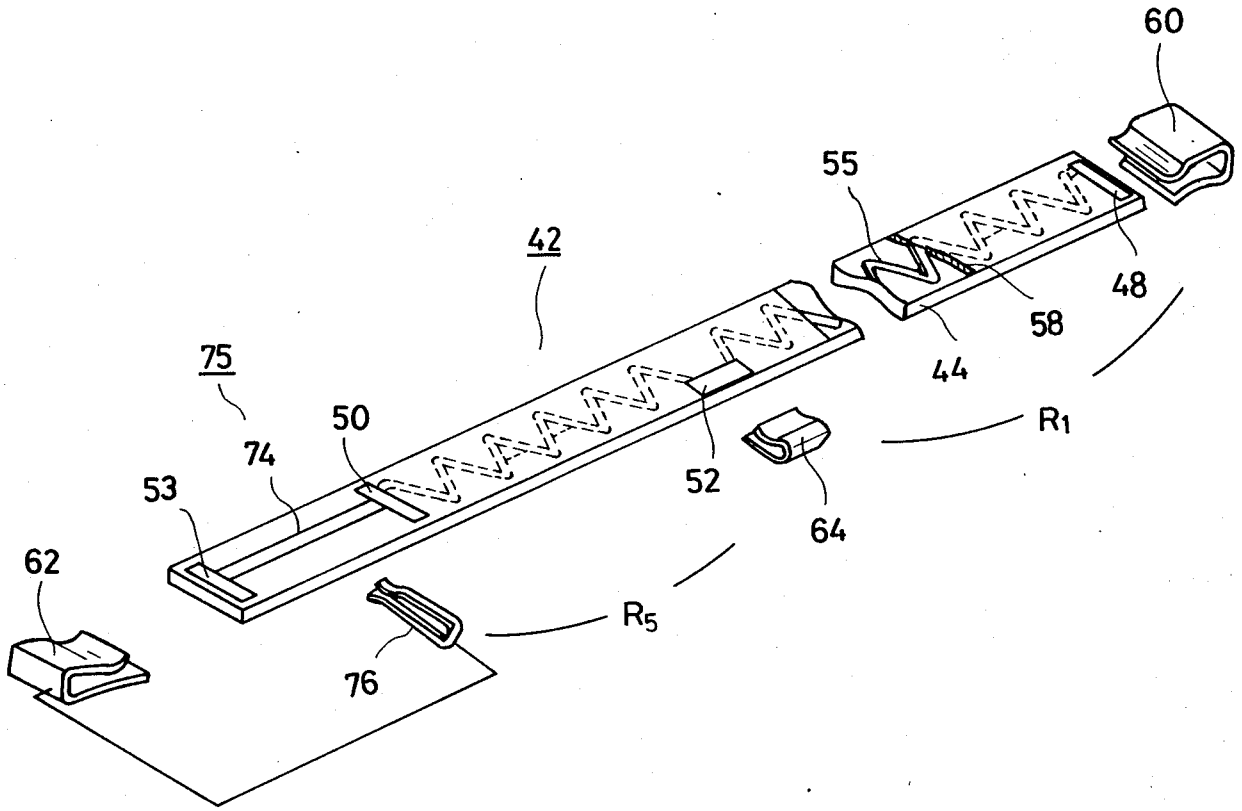
FIG. 8 is a perspective view of an alternative embodiment of the present invention.

FIG. 8 shows a further embodiment of the present invention. In this embodiment the resistive layer 74 of the additional resistor 75 is not covered by insulating layer 58. Resistive layer 74 is made of relatively lower resistive material than the left portion. Resistive layer 74 has a "line" shape, rather than a zigzag shape. A connector 76 is slidably attached to the resistive layer 74 and is fixed at a suitable position. In this embodiment resistive layer 74 is made of a material having lower specific resistance than that of the resistive layer of the main resistor to lengthen the additional resistor portion. This makes it easy to adjust the slidable adjustment. A change of the value of resistor 42 is continuous and the resistive value can be adjusted very fine.

Figure 9:
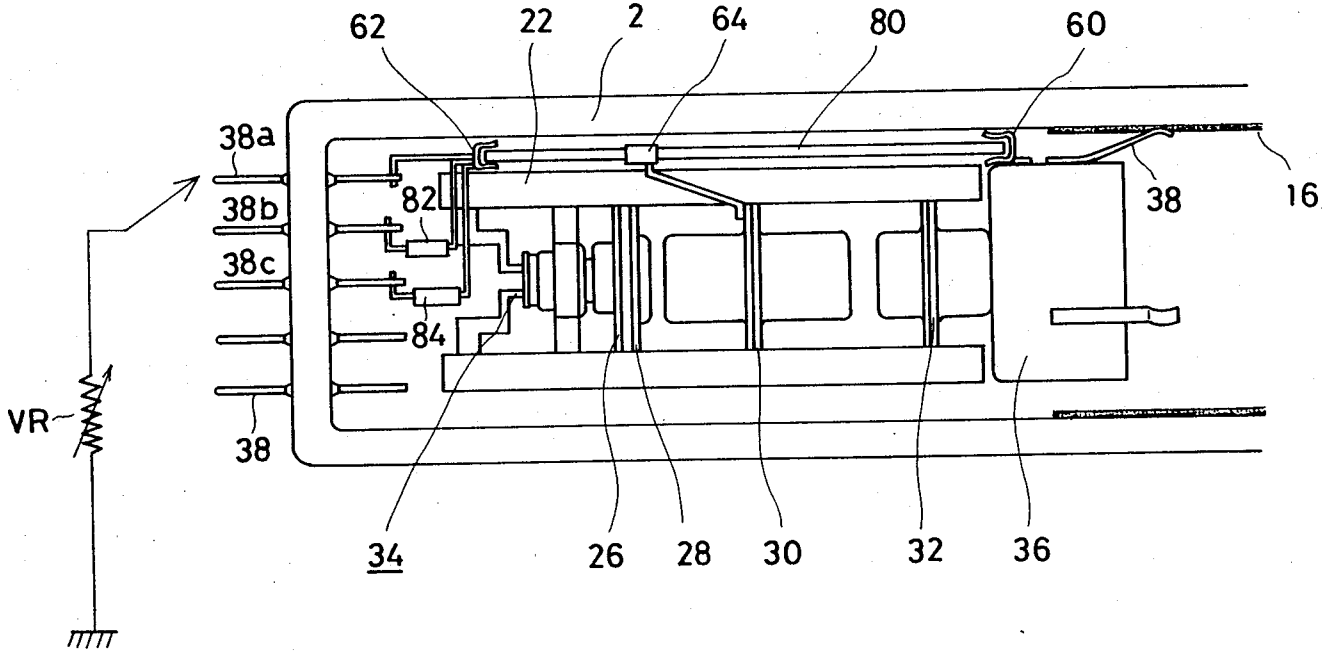
FIG. 9 is a cross section of a further embodiment of the present invention.

FIG. 9 shows an alternative embodiment of the invention. The built-in resistor 42 includes a main resistor 80 and additional resistors 82 and 84, which are separate from each other. The main resistor 80 comprises an insulating substrate, a resistive layer printed on the insulating substrate, first, second and third terminal and an insulating layer covering the resistive layer and the surface of the insulating substrate. This structure is the same as the resistor shown in above-mentioned embodiments except that an additional resistor is not formed on the substrate of the main resistor. In this embodiment a plural of individual resistors 82 and 84 are provided as an additional resistor means. The individual resistors have different resistive value from each other to enable the compensation of the deviation of the resistive value of the main resistor. Additional resistors 82 and 84 are connected between the second terminal of the main resistor and stem pins 38*a* and 38*b* respectively. The second terminal is wired to stem pin 38*a* without any additional resistor.

Figure 10:
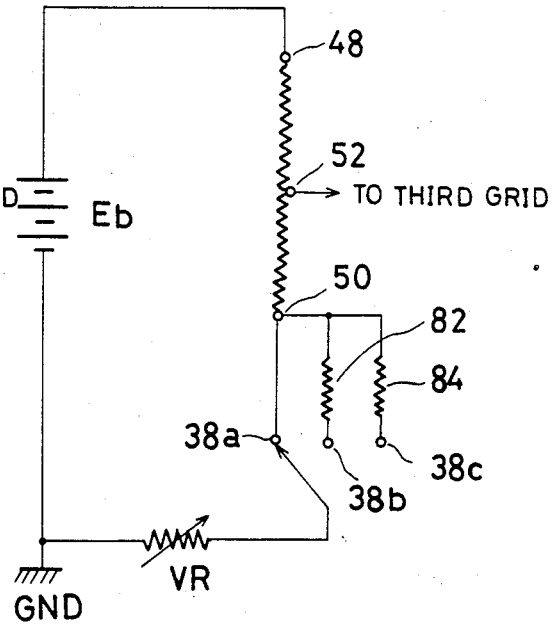
FIG. 10 is a schematic diagram of equivalent circuit of the embodiment shown in FIG. 9.

FIG. 10 is a schematic diagram of an equivalent circuit of the FIG. 9 embodiment.

According to the present invention the deviation of the resistive value, which is caused by the production process, can be compensated and the divisional potential can be set within a compensatable range by the additional variable resistor. The tolerance of the resistive value of the resistor becomes generous and a production yield can be improved. This reduces the manufacturing price of the cathode ray tube. If a severe quality control of the production process is carried out, the additional variable resistor can be eliminated.

Other embodiments and modification of the present invention will be apparent to those of ordinary skill in the art having the benefit of the teaching presented in the foregoing description and drawings. It is therefore, to be understood that this invention is not to be unduly limited and such modifications are intended to be included within the scope of the appended claims.

What is claimed is:

1. A resistor for being installed within an envelope of a cathode ray tube (CRT), for dividing an applied potential into an intermediate potential below said applied potential, comprising:

a main resistor element including an insulating substrate, a main resistive layer provided on said insulating substrate, first and second terminals electrically coupled to said resistive layer at first and second ends thereof, and a third terminal in contact with said resistive layer at a position there along between said first and second terminals; and additional resistor means connected in circuit with said main resistor element for adjusting a divide ratio of a resistive divider formed by said main resistor element and said additional resistor means, thereby controlling said intermediate potential, said additional resistor means including (a) an additional resistive layer provided on said insulating substrate, said additional resistive layer being in contact with said second terminal and (b) a plurality of adjusting terminals at positions along said additional resistive layer, whereby connecting to different ones of said adjusting terminals alters said divide ratio.

2. A resistor according to claim 1, wherein said main resistive layer is zigzag shaped.

3. A resistor according to claim 2 wherein said additional resistive layer is zigzag shaped.

4. A resistor according to claim 2 wherein said additional resistive layer has a straight shape.

5. A resistor according to claim 1, wherein said additional resistive layer has a lower resistive value per unit length than said main resistive layer.

6. A resistor according to claim 4, wherein said additional resistor means further includes a slidable connector in contact with said straight resistive layer.

7. A resistor according to claim 1, wherein one of said adjusting terminals is wired to a stem pin of said CRT.

8. A resistor according to claim 7, wherein said second terminal and said adjusting terminals are wired to different stem pins, respectively, of said CRT.

9. A resistor according to claim 1, further comprising an insulating material covering said main resistive layer, said additional resistive layer and said insulating substrate except for said terminals.

10. A resistor according to claim 1, wherein said first terminal is in electrical contact with an anode button of said CRT and said third terminal is in electrical contact with a focusing electrode of an electron gun of said CRT.

11. A cathode ray tube (CRT) arrangement, comprising:

a main resistor element inside said CRT, said main resistor element including an insulating substrate, a main resistive layer provided on said insulating substrate, first and second terminals in contact with said resistive layer at different positions there along from each other and a third terminal in contact with said resistive layer at a position there along between said first and second terminals;

an additional resistor, inside said CRT including an additional resistive layer provided on said insulating substrate, which is in contact with said second terminal; and a variable resistor, outside said CRT, said main resistor element, additional resistor and variable resistor being connected to form a divider having an adjustable divide ratio, to thereby control a divided potential resulting from voltage applied to said divider, wherein said additional resistive layer has a different resistive value per unit length than said main resistive layer.

12. A resistor according to claim 11, wherein said main resistive layer is zigzag shaped.

13. A resistor according to claim 12 wherein said additional resistive layer is zigzag shaped.

14. A resistor according to claim 11, wherein said additional resistor means further includes a plurality of additional terminals in contact with said additional resistive layer at different positions from each other there along.

15. A resistor according to claim 14, wherein one of said additional terminals is wired to a stem pin of said CRT.

16. A resistor according to claim 15, wherein said second terminal and said additional terminals are wired to different stem pins, respectively, of said CRT.

17. A resistor according to claim 11, further comprising an insulating material covering said main resistive layer, said additional resistive layer and said insulating substrate except for said terminals.

18. A resistor structure for being installed within an envelope of a cathode ray tube (CRT), comprising:

an insulating substrate;

a main resistive layer provided on a first portion of said substrate;

a second resistive layer having first and second ends provided on a second portion of said substrate;

a first terminal in contact with a first end of said main resistive layer;

a second terminal in contact with a second end of said main resistive layer and in contact with a first end of said second resistive layer;

a third terminal in contact with said main resistive layer at a position between said first and second terminals;

a plurality of further terminals in contact with said second resistive layer;

means for applying a first potential to said first terminal;

means for applying a second potential to either said second terminal or to one of said further terminals; and means for deriving a divided potential from said third terminal for application to an electrode of said CRT, the divided potential derived thereby being a function of which terminal the second potential is applied to.

19. A resistor structure according to claim 18 wherein said second resistive layer is zigzag in shape.

20. A resistor structure according to claim 18, where said second resistive layer is straight.

21. A resistor structure according to claim 20 further including a slidable connector in contact with said second resistive layer.

22. A resistor structure according to claim 18, wherein said second resistive layer has a lower resistive value per unit length than that of said first resistive layer.

23. A resistor structure according to claim 18 further including additional terminals in contact with said second resistive layer.

24. A resistor structure according to claim 18 further including an insulating material covering said first and second resistive layers, but not covering any of said terminals.

25. A resistor for being installed within an envelope of a cathode ray tube, for dividing an applied potential into an intermediate potential below said applied potential, comprising:

a main resistor element including an insulating substrate having first and second surfaces, a main resistive layer provided on said first surface of said insulating substrate, and first and second terminals in contact therewith at respective ends thereof; and additional resistor means connected in circuit with said main resistor element for adjusting a divide ratio of a resistive divider formed by said main resistor element and said additional resistor means, thereby controlling said intermediate potential, said additional resistor means including an insulating substrate, said additional resistive layer being in contact with said second terminal and having a different resistive value per unit length than said than said main resistive layer.

26. A resistor according to claim 25, wherein said main resistive layer is zigzag shaped.

27. A resistor according to claim 26, wherein said additional resistive layer is zigzag shaped.

28. A resistor as in claim 27 further comprising a plurality of adjusting terminals on said additional resistive layer, said adjusting terminals being coupled to the additional resistive layer at apexes of the zigzag shape, thereby providing a plurality of adjusting terminals.

29. A resistor as in claim 28 further comprising a plurality of clip-on terminals, each of which include:

(a) a biasing surface, adapted to be located against said second surface of said insulating substrate;

(b) a contact surface, opposing said biasing surface and adapted to contact one of said terminals on said resistor;

(c) means for attaching an electrical wire to said clip-on terminal in such a way that said wire is in electrical contact with said contact surface; and (d) spring bias means for producing a spring bias force between said biasing surface and said contact surface to bias said contact surface tightly against said first surface of said insulating substrate.

30. A resistor as in claim 25 further comprising a plurality of clip-on terminals, each of which include:

(a) a biasing surface, adapted to be located against said second surface of said insulating substrate;

(b) a contact surface, opposing said biasing surface and adapted to contact one of said terminals on said resistor element;

(c) means for attaching an electrical wire to said clip-on terminal in such a way that said wire is in electrical contact with said contact surface; and (d) spring bias means for producing a spring bias force between said biasing surface and said contact surface, to bias said contact surface tightly against said first surface of said insulating substrate.

31. A resistor as in claim 30, wherein each said clip-on terminal further comprises:

(e) welding area means, adapted to be soldered to said first surface of said insulating substrate at a position of one of said terminals.

32. A resistor assembly for installation within an envelope of a cathode ray tube for performing a voltage division operation, comprising:

a main resistor element including an insulating substrate having first and second surfaces, a main resistive layer provided on said first surface of said insulating substrate, first and second substrate terminals electrically coupled to said resistive layer at first and second ends thereof respectively, and a third substrate terminal in contact with said resistive layer at a position between said first and second terminals;

additional resistor means, coupled in series with said main resistor element, for adjusting a divide ratio of a resistive divider formed with said main resistor element and said additional resistor means, said additional resistor means including an additional resistive layer coupled to said second substrate terminal, and a plurality of adjusting substrate terminals coupled to positions on said additional resistor means along said additional resistive layer, different resistances being formed between each adjusting substrate terminal and said second substrate terminal; and a plurality of clip on terminal means for connecting to said substrate terminals, each of which include:

(a) a biasing surface, adapted to be located against said second surface of said insulating substrate;

(b) a contact surface, opposing said biasing surface and adapted to contact one of said substrate terminals on said resistor;

(c) means for attaching an electrical wire to said clip on terminal in such a way that said wire is in electrical contact with said contact surface; and (d) spring bias means for producing a spring bias force between said biasing surface and said contact surface to bias said contact surface tightly against said first surface of said insulating substrate.

33. An assembly as in claim 32, wherein each said clip on terminal further comprises:

(e) welding area means, for soldering said to said first surface of said insulating substrate at a position of one of said substrate terminals.

34. An assembly as in claim 33, wherein said main resistive layer and said additional resistive layer are both formed in a substantially zigzag shape, having a plurality of zigzag portions, each one zigzag portion traversing a different direction to each adjacent zigzag portion, and a plurality of apexes coupling each one zigzag portion to each adjacent zigzag portion.

35. An assembly as in claim 34, wherein said adjusting substrate terminals are coupled to said zigzag only at said apexes thereof.

36. An assembly as in claim 35, wherein there is one adjusting substrate terminal at each of said apexes and one of said clip on terminals are adapted to be welded to one of said adjusting substrate terminals.

37. An assembly as in claim 33, wherein said additional resistor means is of a substantially straight shape and one of said clip on terminal means is adapted to be welded to said additional resistive layer at any position there along.

38. An assembly as in claim 33, wherein a resistance per unit length of said main resistive layer is different from a resistance per unit length of said additional resistive layer.

39. A resistor for being installed within an envelope of a cathode ray tube (CRT) having an electron gun with a plurality of electrodes, for dividing an applied potential into an intermediate potential for one of said electrodes, said intermediate potential being below said applied potential, comprising:

a main resistor element including an insulating substrate, a main resistive layer provided on said insulating substrate, first and second terminals electrically coupled to said resistive layer at first and second ends thereof, and a third terminal in contact with said resistive layer at a position therealong between said first and second terminals, said third terminal being electrically coupled to said one of said electrodes; and additional resistor means connected in circuit with said main resistor element for adjusting a divide ratio of a resistive divider formed by said main resistor element and said additional resistor means, thereby controlling said intermediate potential, said additional resistor means including (a) an additional resistive layer provided on said insulating substrate, said additional resistive layer being in contact with said second terminal and (b) a plurality of adjusting terminals at positions along said additional resistive layer, said second terminal and said plurality of additional terminals including at least two terminals not connected to any one of said electrodes of said electron gun.

* * * * *